US011634933B2

(12) United States Patent
Wang

(10) Patent No.: US 11,634,933 B2
(45) Date of Patent: Apr. 25, 2023

(54) DOOR HANDLE LOCK AND LOCKING METHOD

(71) Applicant: Ningbo Eudemon Child Protective Equipment Co., Ltd., Zhejiang (CN)

(72) Inventor: Zhangjun Wang, Zhejiang (CN)

( * ) Notice: Subject to any disclaimer, the term of this patent is extended or adjusted under 35 U.S.C. 154(b) by 353 days.

(21) Appl. No.: 16/587,969

(22) Filed: Sep. 30, 2019

(65) Prior Publication Data

US 2020/0392762 A1 Dec. 17, 2020

(30) Foreign Application Priority Data

Jun. 14, 2019 (CN) ..... 201910516960.6

(51) Int. Cl.
*E05B 65/00* (2006.01)
*E05B 13/00* (2006.01)

(52) U.S. Cl.
CPC ..... *E05B 65/0014* (2013.01); *E05B 13/00* (2013.01); *E05B 13/002* (2013.01)

(58) Field of Classification Search
CPC .... E05B 65/0014; E05B 13/007; E05B 13/00; E05B 13/002; E05B 13/001; E05B 15/008; E05B 17/2019; E05B 17/2015; E05B 17/52; E05C 17/54; E05C 19/18; E05C 19/188; E05C 17/48; Y10T 292/57; Y10T 292/34; Y10T 292/37; Y10T 292/379; Y10T 292/388; Y10T 292/391; Y10T 292/82; Y10T 292/85; Y10T 292/03; Y10S 292/02; Y10S 292/65
See application file for complete search history.

(56) References Cited

U.S. PATENT DOCUMENTS

| | | | | |
|---|---|---|---|---|
| 2,573,061 | A * | 10/1951 | Raymond | E05B 83/30 70/81 |
| 4,471,980 | A * | 9/1984 | Hickman | E05C 19/06 292/19 |
| 7,048,315 | B2 * | 5/2006 | Wong | E05B 13/002 292/297 |
| 8,177,268 | B2 * | 5/2012 | Varney | E05B 13/00 292/297 |
| 10,221,587 | B1 * | 3/2019 | Bergman | E05B 13/002 |
| 2006/0076787 | A1 * | 4/2006 | Sundberg | E05B 13/002 292/336.3 |
| 2013/0180296 | A1 * | 7/2013 | McEachern | E05B 65/08 292/300 |
| 2017/0275928 | A1 * | 9/2017 | Kozlowski | E05C 17/52 |

* cited by examiner

*Primary Examiner* — Christine M Mills
*Assistant Examiner* — Peter H Watson
(74) *Attorney, Agent, or Firm* — Rumit Ranjit Kanakia

(57) ABSTRACT

A door handle lock and a locking method are provided. The door handle lock comprises a first lock body, a second lock body, and a locking part, and the locking part is engaged with a movable part to lock the first lock body, thus being difficult to unlock. The door handle lock is mounted within a rotation range of the door handle, and the rotation of the door handle is limited by the first lock body. Such a setting effectively prevents a child from unlocking without permission and then opening the door to escape, thus improving the security.

7 Claims, 19 Drawing Sheets

DOOR HANDLE LOCK AND LOCKING METHOD

TECHNICAL FIELD

The present invention relates to the field of lock devices, and in particular, to a door handle lock and a locking method.

BACKGROUND

As is well known, external risk factors have greater impacts on children because their bodies and minds are growing. Children's safety problems are relatively trivial. For example, a child is prone to safety problems when he/she runs out by turning the door lock open without being noticed by his/her guardian. Moreover, most door locks can be unlocked easily only by twisting the door handle. In view of this, a child safety lock emerges on the market, in which two rotary lock bodies are mounted on a carrier to limit the door handle between the two lock bodies to form a limit. The door can be unlocked only by turning the lock body at one side. This unlocking process is simple and can be easily imitated by a child who may further unlock without permission, and thus it needs to be improved.

SUMMARY OF THE INVENTION

In view of the above, an objective of the present invention is to provide a door handle lock to solve the above problems.

In a first aspect of this application document, a door handle lock is provided, and the technical solution is as follows.

A door handle lock, comprising a first lock body, a second lock body, and a locking part, wherein the locking part is used to limit the first lock body;

the first lock body is provided with a movable part, and the movable part and the corresponding second lock body are respectively provided with concave and convex members to form engagement; and under the action of an external force, the locking part removes the limit, the movable part is released from the concave and convex engagement, and the first lock body moves under the drive of the external force.

According to the door handle lock, the locking part is engaged with the movable part to lock the first lock body, thus being difficult to unlock. The door handle lock is mounted within a rotation range of the door handle, and the rotation of the door handle is limited by the first lock body. Such a setting effectively prevents a child from unlocking without permission and then opening the door to escape, thus improving the security.

Definitely, the door handle lock can also be mounted onto an apparatus such as a window that needs to be unlocked by turning a handle.

Further, concave and convex members are constructed to form engagement: the movable part is provided with a convex part and/or a groove, the corresponding second lock body is correspondingly provided with a groove and/or a convex part, the convex part extends into the groove to form engagement, and under the action of an external force, the convex part is separated from the groove to be released from the concave and convex engagement.

The convex part is engaged with the groove to limit the movement of the first lock body.

In addition, the movable part is preferably mounted on two opposite sides of the first lock body. The advantage of this structure is that: during unlocking, at least three fingers are required to cooperate with each other for unlocking, which increases the difficulty of unlocking.

Further, the second lock body is provided with a slot, the first lock body is placed in the slot and the concave and convex members on the movable part of a side surface thereof are engaged with concave and convex members on a slot wall of the second lock body.

Preferably, two ends of the slot of the second lock body are both provided with concave and convex members, and then the first lock body is displaced to remove the limit to the rotation of the door handle with one end in a first locked state and the other end in a second locked state.

Further, the end of the slot is further provided with a first pushing block, an indicator block is movably mounted on the corresponding first lock body, and during displacement of the first lock body, the first pushing block drives the indicator block to displace.

In this technical solution, the indicator block is used to indicate the state of the first lock body, such as unlocked or locked, for example, color bars are painted on the indicator block or Chinese characters or letters are marked thereon. Under the drive of the first pushing block, the indicator block is displaced to expose the color bar, Chinese characters or letters on the end to indicate the locked state of the first lock body.

An optional structure for movable mounting includes sliding fit, that is, the first lock body is provided with a slot, the indicator block is placed in the slot, and the first pushing block extends from below the indicator block and gradually jacks up the indicator block as the first lock body moves.

Further, a base is disposed at the bottom of the first lock body to slidably fit with the slot wall of the second lock body.

The base is slidably fitted with the second lock body. Preferably, the slot wall of the second lock body is provided with a slot, and two sides of the base are placed in the slot for smooth sliding.

Further, the movable part is rotatably connected to the first lock body.

For example, the end or the middle portion of the movable part is hinged to the first lock body by a pin shaft, and the pin shaft is sheathed with a torsion spring, thus being conducive to resetting.

Further, the end of the movable part is connected to the first lock body, and the movable part is rotated around the end when pressed by an external force.

Further, the movable part is configured to be plate-like and made of an elastic material. An end thereof is connected to the first lock body, and the other opposite end is provided with concave and convex members to be engaged with the concave and convex members on the second lock body. The movable part is rotated around a joint with the first lock body when the other end is pressed by an external force.

The movable part is plate-like and connected to the first lock body with one end. During unlocking, the concave and convex members can be separated by gently pressing the plate body. The movable part is made of plastic, a polymer material, metal, etc. When the movable part is made of plastic, a polymer material, or metal, an end of the plate body is directly connected to the first lock body, for example, the movable part is mounted on two opposite sides of the first lock body. In addition, two movable parts are optionally directly integrated, such as, U-shaped, to be directly clamped to the first lock body. Concave and convex members are mounted at the bottom of two longitudinal surfaces of the U-shaped body. The movable parts can be released from the engagement to the concave and convex members of the second lock body by pressing the two longitudinal surfaces of the U-shaped body.

Definitely, the movable part can also be directly integrally formed with the first lock body.

Further, the movable part is elastically retractable, one end thereof is connected to the first lock body, the other end opposite portion is provided with concave and convex members to be engaged with the concave and convex members on the second lock body, and when the other end is pressed, the movable part contracts to be released from the concave and convex engagement with the second lock body.

For example, the movable part is in the shape of a cylinder, a spring is mounted between two sides at the bottom of the cylinder and the first lock body, the top portion thereof is provided with concave and convex members to be engaged with the concave and convex members on the second lock body, the movable part is pressed to contract so as to be released from the concave and convex engagement for unlocking.

Further, the locking part is configured to include a body having one end fixed to the second lock body and the other end abutting against the first lock body for limiting, and the other end of the body is pressed to be released from the limit.

In this technical solution, the locking part limits the movement of the first lock body by directly abutting against the first lock body. In this structure, the body is optionally made of plastic, a polymer material, or metal. When the body is optionally made of plastic or a polymer material, the body is plate-like, one end is connected to the second lock body, the other end is warped up to abut against the first lock body, and unlocking can be performed by pressing the other end. Definitely, when the body is optionally made of metal, one end of the plate-like body is rotatably connected to the second lock body, such as using a pin shaft provided with a torsion spring.

Further, the locking part is configured as a cylinder having a concave and convex surface, the cylinder being movably mounted onto the first lock body.

A movable part is disposed on a side surface of the first lock body. In a locked state, the movable part is engaged with the concave and convex members on the corresponding second lock body. The corresponding position of an inner side surface of the movable part corresponds to the convex part on the surface of the cylinder to limit the movement of the movable part. The cylinder is pressed and displaced so that the corresponding position of the inner side surface of the movable part corresponds to the concave part on its surface. The movable part is pressed and moved to be released from the concave and convex engagement with the second lock body for unlocking.

In this technical solution, the locking part is disposed on the first lock body. The locking part is of a cylinder structure. The first lock body is provided with a hole for mounting the cylinder, which has a concave and convex surface. When the movable part is pressed and moved, the convex part abuts against the movable part to thus limit the displacement of the movable part. By displacing the cylinder, the convex part is displaced from the original position. When the movable part is pressed, the movable part is moved to be released from the concave and convex engagement with the second lock body.

Further, the front or back of the first lock body is provided with a mounting hole for mounting the cylinder. The first lock bodies on two sides of the mounting hole are each provided with a movable part. After being in a locked state, the cylinder and the movable parts on two sides need to be pressed for unlocking, and at least three fingers are required to cooperate, so that it cannot be easily unlocked by a child.

Further, the position of the inner side surface of the movable part corresponding to the projecting part of the surface of the cylinder is provided with a convex part. In the locked state, the projecting part on the cylinder corresponds to the convex part on the inner side surface of the movable part to limit the movement of the movable part. During unlocking, the cylinder is pressed and moved to cause a concave part on the cylinder to correspond to the convex part on the inner side surface of the movable part. The movable part is pressed and moved to be released from the concave and convex engagement with the second lock body.

When the convex parts abut against each other, the displacement of the movable part is limited by the cylinder. When the concave part is engaged with the convex part, the movable part is displaced towards the inner side when pressed, and then the movable part is released from the concave and convex engagement with the second lock body, thus simplifying the structure.

Further, a second pushing block and a third pushing block are further included. The second pushing block is mounted onto the second lock body. The third pushing block is movably mounted in the first lock body. During the displacement of the first lock body, the second pushing block is displaced and the third pushing block abuts against and fixes the cylinder.

Further, the first lock body is provided with an accommodating slot in which the third pushing block is placed. The mounting hole of the cylinder is located above the accommodating slot. The second pushing block is fixed to an end of the second lock body, and the first lock body is provided with a hole on a surface towards the second pushing block, which is in communication with the accommodating slot. After unlocking, in the process of pressing the cylinder to displace the first lock body, the second pushing block extends into the accommodating slot from the hole and jacks up the third pushing block to cause the third pushing block to abut against and fix the cylinder.

Further, the end of the second pushing block is arc-shaped, the second pushing block abuts against the bottom of the third pushing block, and with the displacement of the first lock body, the third pushing block moves along the second pushing block and rises to abut against and fix the cylinder.

In addition, preferably, the second pushing block is integrally designed with the first pushing block. During the displacement of the first lock body, the integrated pushing block abuts against and displaces the indicator block and the third pushing block at the same time, thus simplifying the structure.

Further, the cylinder includes a first cylinder and a second cylinder, the front or back of the first lock body is provided with a first mounting hole for mounting the first cylinder, the bottom of the first lock body is provided with a second mounting hole for mounting the second cylinder, and the first lock bodies on two sides of the second mounting hole are each provided with a movable part, wherein the first mounting hole is disposed horizontally, the second mounting hole is disposed vertically, the first mounting hole is connected to the second mounting hole, an end of the first cylinder opposite the second cylinder is an inclined surface, the first cylinder retracts inward when pressed by an external force, and the first cylinder abuts against and presses the second cylinder downward so that a projecting part on the surface of the second cylinder is released from limiting the movable part.

In this technical solution, the movable part is limited by the convex part on the second cylinder, wherein the top of the second cylinder is an upper slope, the end of the first cylinder is a lower slope, the upper slope of the first cylinder is attached to the upper slope of the second cylinder by pressing the first cylinder to displace, and as the first cylinder is pressed continuously, the first cylinder presses the second cylinder downward, and the convex part on the second cylinder is displaced to be released from limiting the movable part. In this case, unlocking is completed by pressing the movable part.

Further, a fourth pushing block is further included, which is mounted to the end of the second lock body. With the movement of the first lock body, the fourth pushing block extends from below the second mounting hole and fixes the second cylinder to form a second locked state.

Further, a pressing block is disposed on a surface of the second cylinder towards the fourth pushing block. With the movement of the first lock body, the fourth pushing block is pressed over the pressing block.

Further, the movable part is a barrel sheathed on the first lock body, and ends on two opposite side surfaces of the barrel form movable ends.

Further, an elastic member is mounted between the cylinder and the first lock body, thus being conducive to resetting the cylinder. This elastic member is selected from a spring or prepared by an elastic material such as rubber, so as to reset the cylinder with an elastic force after the cylinder moves.

Further, the first lock body and the second lock body are each of a separated structure.

For example, the second lock body adopts a separated structure, in which upper and lower parts are fixed by embedment or left and right parts are fixed by embedment, or left and right parts of the first lock body are fixed by embedment or upper and lower parts are fixed by embedment, or fixed by bolts, and so on.

Definitely, it is also possible that the first lock body is an integrated structure, and the second lock body is an integrated structure.

In addition, the first lock body and the second lock body may be selected from materials including plastic, a polymer material, and metal.

In a second aspect of this application document, a locking method is further provided, which comprises the following steps:

providing a first lock body;

providing a second lock body along which the first lock body moves;

providing a movable part mounted on the first lock body and forming concave and convex engagement with the second lock body;

providing a locking part to limit the first lock body; and pressing the locking part and the movable part at the same time during unlocking, thus moving the first lock body.

The present invention has the following beneficial effects: the door handle lock has a simplified structure and improves the difficulty in unlocking, thus effectively preventing a child from unlocking.

DETAILED DESCRIPTION OF THE PREFERRED EMBODIMENTS

Specific implementation manners of the present invention are further described in detail in the following with reference to the accompanying drawings to make the technical solutions of the present invention easier to understand and grasp.

A locking method is provided in this application, including the following steps: providing a first lock body;

providing a second lock body along which the first lock body moves;

providing a movable part mounted on the first lock body and forming concave and convex engagement with the second lock body;

providing a locking part to limit the first lock body; and pressing the locking part and the movable part at the same time during unlocking, thus moving the first lock body.

A door handle lock is further provided in the present invention, and the specific technical solution is described in the following examples.

Example 1

Figure 1:
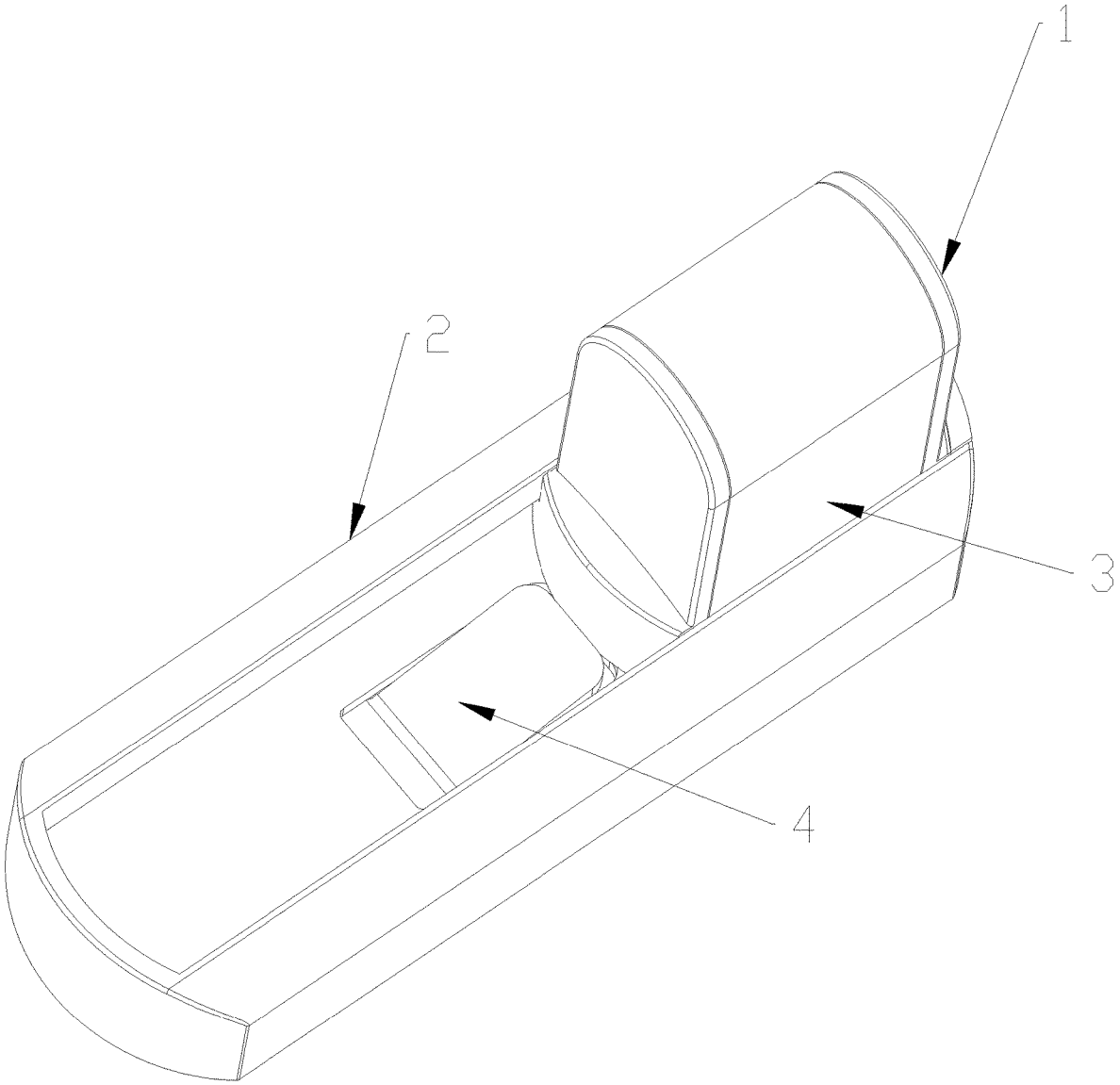
FIG. 1 is a structural diagram of a door handle lock according to Example 1.
Figure 2:
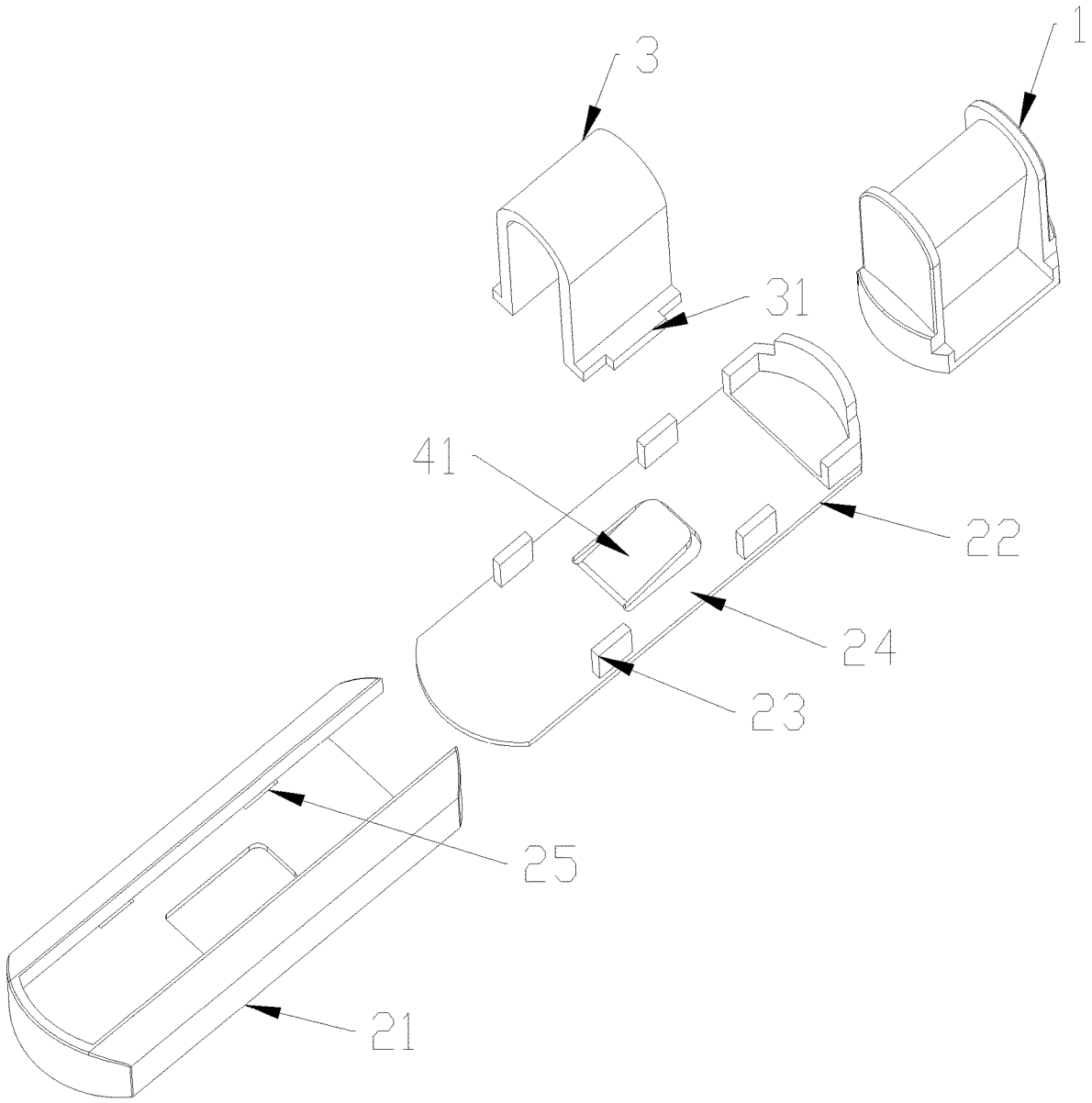
FIG. 2 is an exploded structural diagram of the door handle lock according to Example 1.
Figure 3:
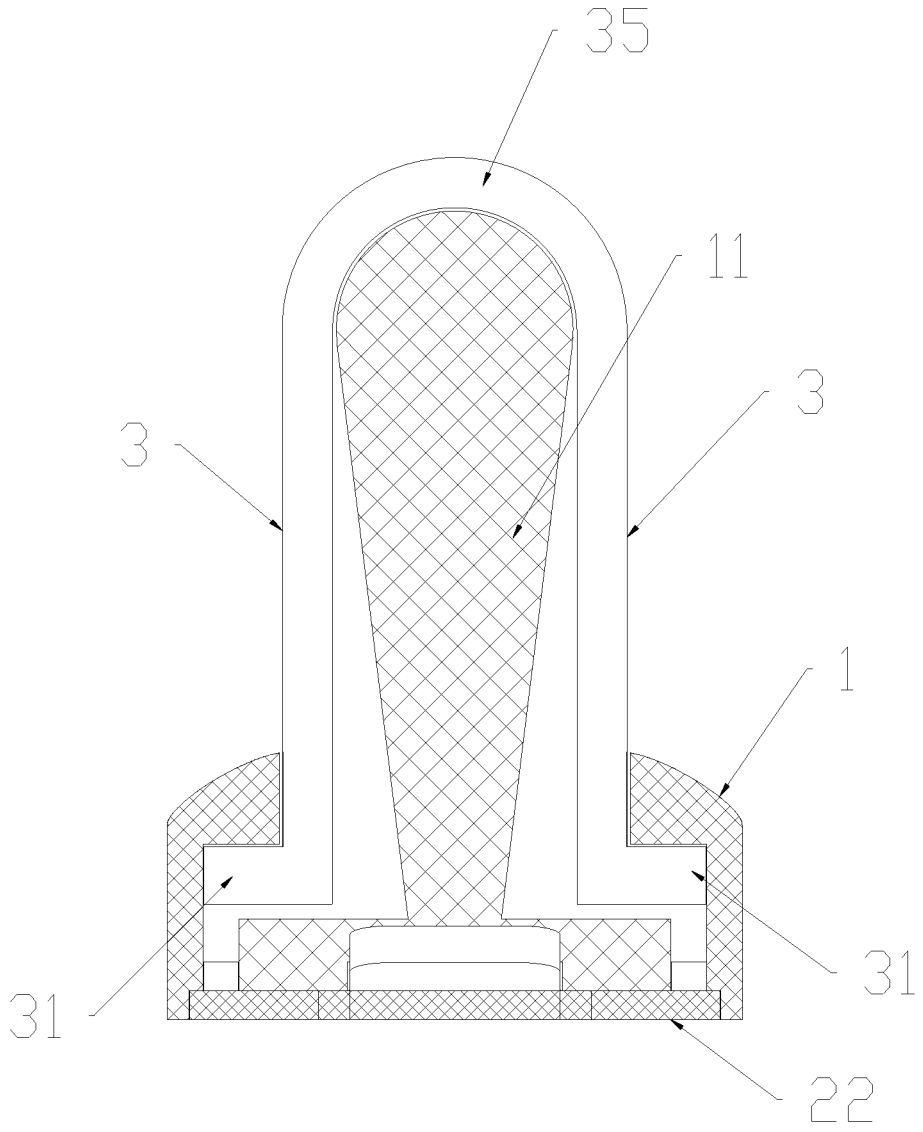
FIG. 3 is a sectional diagram of a mounting structure of a first lock body according to Example 1.

Referring to FIG. 1, in this example, the door handle lock includes a first lock body 1, a second lock body 2, and a locking part 4. Referring to FIG. 2 and FIG. 3, the first lock body is an integrated structure and is T-shaped on the whole. The longitudinal part of the T-shaped body is a fan-shaped body 11. In this example, the movable part 3 is plate-like, the movable parts on two opposite side surfaces of the T-shaped first lock body are connected into a whole and form a U shape. The U-shaped body 35 is directly fixed to the longitudinal part of the T-shaped body by embedment, that is, the top of the longitudinal part of the T-shaped body is concave, and the inverted U-shaped body is directly embedded in and fixed to the concave part of the longitudinal part of the T-shaped body. Two longitudinal surfaces of the U-shaped body form the movable parts, and a convex part is disposed at the bottom of the longitudinal surface to form a convex member 31.

Referring to FIG. 2 and FIG. 3, the second lock body is a slot body, and is formed by fixing upper and lower parts by embedment. A plurality of fixing blocks 23 are evenly distributed on two sides of the lower part 22, embedding holes 25 are opened at corresponding position on the upper part 21. When the upper and lower parts are fixed by embedment, the fixing blocks are embedded into the embedding holes. Gaps between the fixing blocks on the same side projecting from the embedding holes form a slot, which is a concave member 24. The convex member of the U-shaped body extends into the concave member to form engagement.

Definitely, as a more optimized selection, the concave member 24 is formed by the fixing blocks on two ends of the slot of the second lock body, and then the first lock body in the unlocked state can cause the U-shaped body to be released from the concave and convex engagement with the second lock body through two fingers so as to move to the other end of the slot of the second lock body along the slot. This structure improves the stability of the first lock body.

In addition, in order to improve the movement stability of the first lock body, the slot of the second lock body is an inverted trapezoid slot, that is, the slot is contracted. This structure prevents the first lock body from disengagement and improves the stability.

Referring to FIG. 2, the locking part 4 is disposed in the middle of the slot of the second lock body. The locking part includes a body 41 having one end fixed to the second lock body and the other end abutting against the first lock body for limiting. The other end of the body is pressed to be released from the limit. Specifically, in this example, a plate is selected as the body, which is integrated with the lower part of the second lock body by injection molding. One end of the body is warped, and the movable part is pressed to rotate inward. In this case, when the first lock body is placed at the end of the second lock body pointed by the warping end of the body, the external force is removed, convex members on two sides of the U-shaped body extend into the concave member of the second lock body, and the warping end of the body abuts against the first lock body. It is now in a first locked state. In this case, the unlocking requires the cooperation of three fingers, it is difficult to unlock and not easily opened by a child. The door handle lock is mounted in a rotation range of the door handle to limit the rotation of the door handle, thus effectively preventing a child from opening the door without permission and running out. During unlocking, the warping end of the body is pressed by one finger, the two sides of the U-shaped body are pressed by two fingers to unlock the lock, a force is applied to the first lock body to move it to the other end of the slot of the second lock body, the external force is removed, and the convex member on the movable part extends into the concave member of the second lock body to form locking. It is now in a second locked state. In this case, the lock can be unlocked only by pressing two side surfaces of the U-shaped body with two fingers, and the second locked state can be released.

Definitely, the door handle lock blocks the door handle from rotating by fixing the first lock body, and releases the limit to the rotation of the door handle by displacing the first lock body. However, in this technical solution, the first lock body is fixed to the second lock body in either the first locked state or the second locked state, that is, the door handle is blocked from rotating in either state. Therefore, when the second lock body is mounted onto the door, it is only necessary to fix either end of the second lock body to any position adjacent to the door handle and make the other end far away from the rotation range of the door handle.

Figure 4:
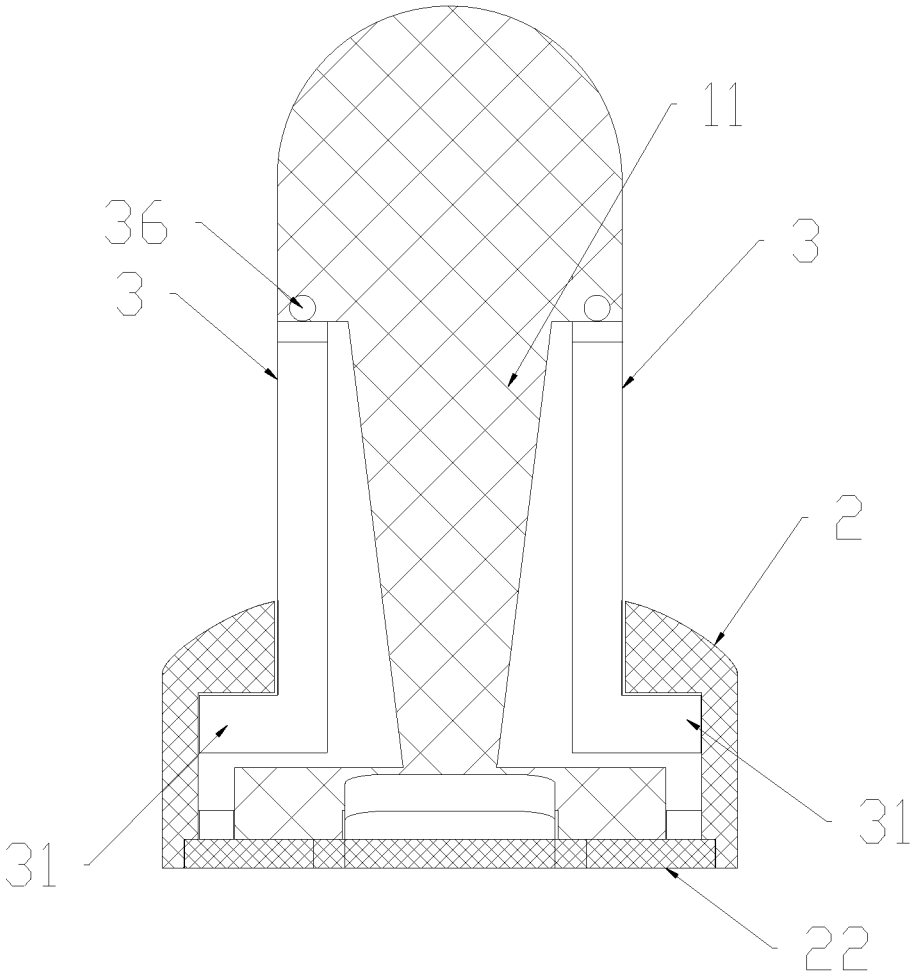
FIG. 4 is a hinged diagram of a movable part according to Example 1.

In addition, the movable part further includes a rotating connection. As shown in FIG. 4, the movable part 3 is plate-like, and is hinged on both sides of the fan-shaped body 11 through a pin shaft 36.

Figure 5:
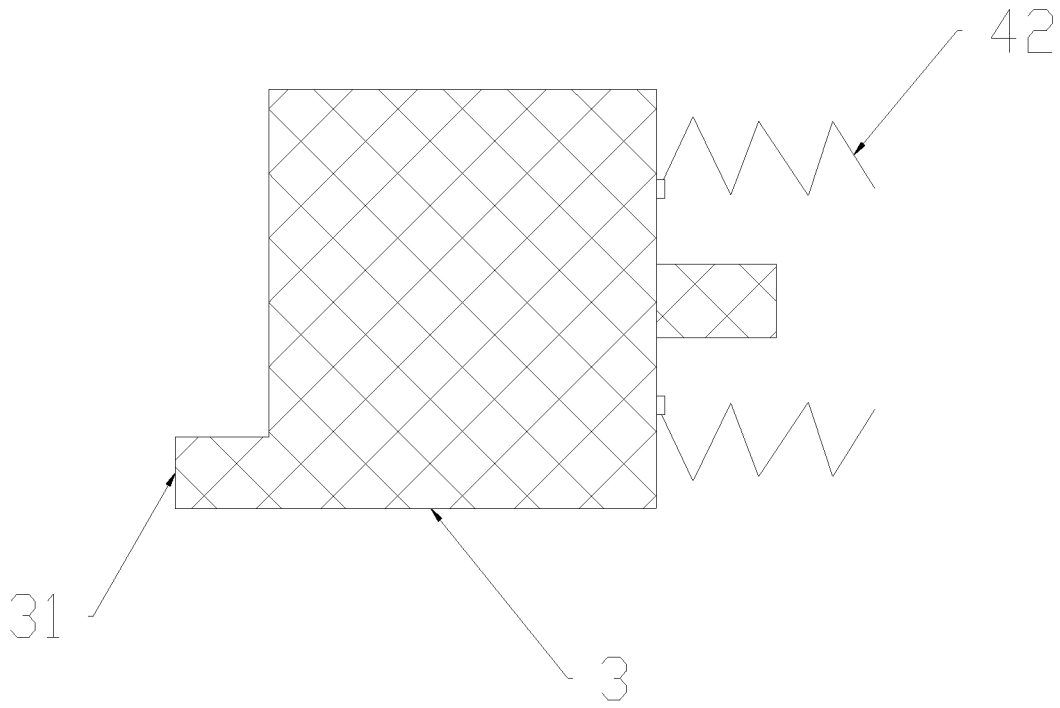
FIG. 5 is a diagram of a telescopic structure of the movable part according to Example 1.

Besides, the movable part further includes an elastic form. As shown in FIG. 5, it is in the shape of a cylinder, the bottom of one end of the cylinder projects to form a convex member, and a spring is mounted between the other end and the fan-shaped body.

Example 2

Figure 6:
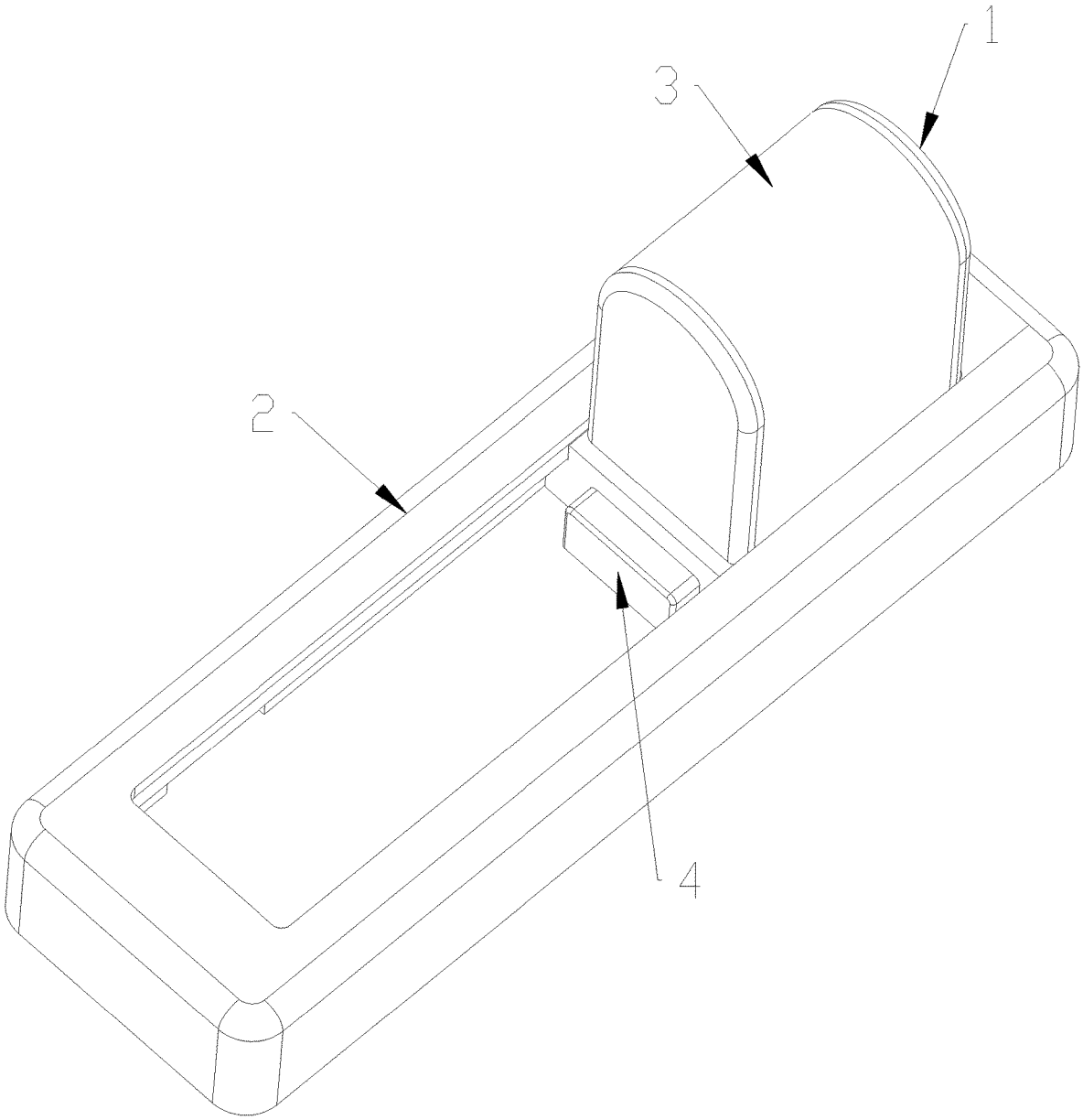
FIG. 6 is a structural diagram of a door handle lock according to Example 2.
Figure 7:
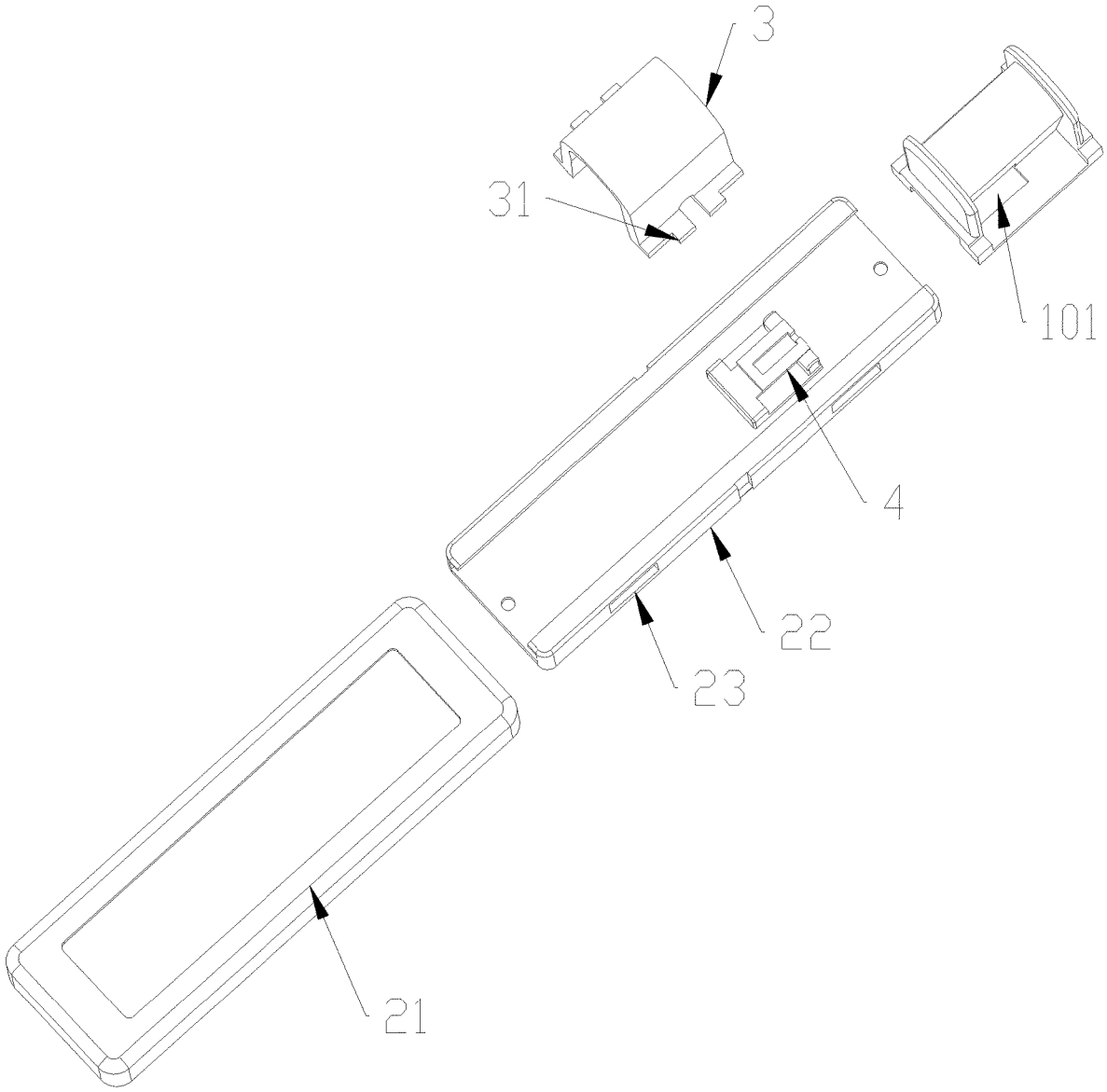
FIG. 7 is an exploded structural diagram of the door handle lock according to Example 2.
Figure 8:
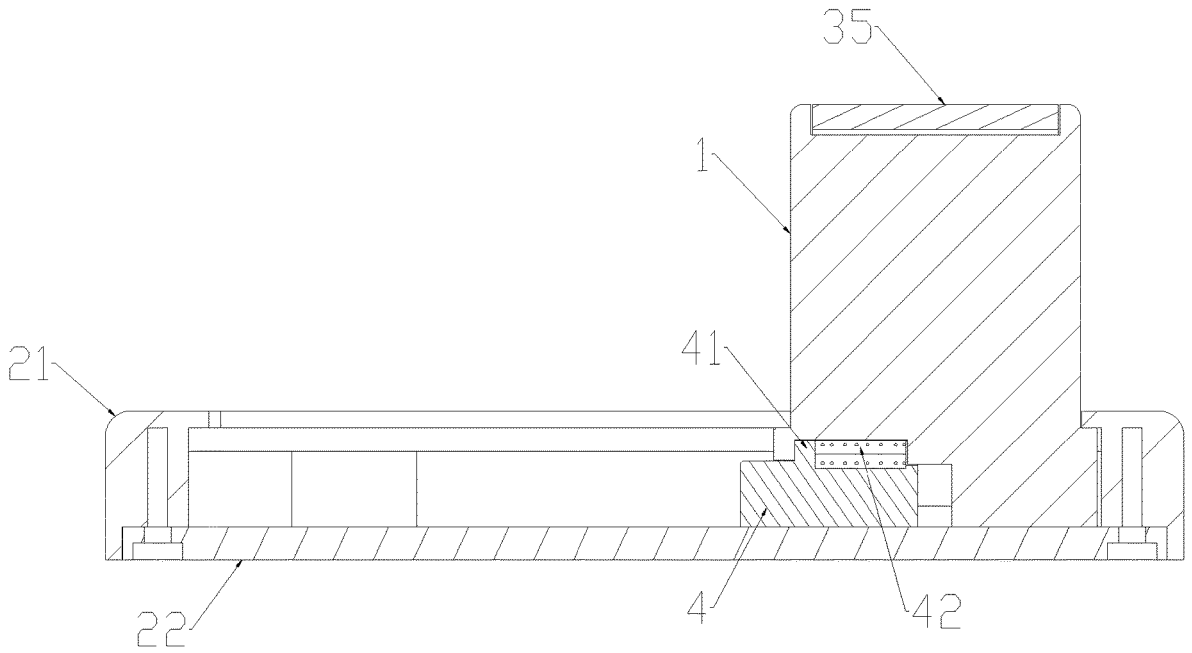
FIG. 8 is a sectional structural diagram of the door handle lock according to Example 2.

Referring to FIG. 6, compared with Example 1, in this example, the locking part 4 is mounted onto the first lock body 1. Referring to FIG. 7 and FIG. 8, the first lock body is T-shaped, and its transverse part is slotted to form a mounting hole 101 for mounting the locking part 4. The locking part is a prism. In this example, a quadrangular prism and a cuboid are selected, and the middle part hereof is concave so that the surface of the cuboid is concave and convex. The longitudinal part of the T-shaped first lock body is a fan-shaped body. In this example, two movable parts 3 are integrated into a U-shaped body, the U-shaped body 35 is fixed to the longitudinal part of the T-shaped body by embedment, and a hole is opened on an inner side surface of the movable part corresponding to a projecting position of the locking part, i.e., the position of the projecting part at the tail end of the locking part. When the projecting part at the tail end of the locking part does not correspond to the hole, inward rotation of the two side surfaces of the U-shaped body is limited by the locking part. When the locking part is pressed to make the projecting part correspond to the hole, the two side surfaces of the U-shaped body are pressed to rotate inward to make it released from the concave and convex engagement with the second lock body. In this case, the first lock body is driven by a force to move along the slot of the second lock body. Compared with Example 1, slot walls on two sides of the lower part 22 of the second lock body are directly provided with holes to form a concave member 24, which is engaged with the convex member on the U-shaped body. Preferably, slot walls on two ends of the lower part 22 of the second lock body are provided with holes to form the concave member 24.

As a more optimized selection, the top of the prismatic locking part is provided with a stop block 41 which protrudes upward. When the locking part is pulled outwards, the stop block abuts against the slot wall to limit displacement. The stop block is integrally formed with the locking part, and the stop block and the opposite slot wall form two mounting ends of an elastic member. A spring 42 is selected as the elastic member.

In addition, as a more optimized selection, in this example, the depth of the slot of the second lock body is increased so that the locking part is partially located in the slot. When the first lock body is in the first locked state, the first locked state is released by pressing the locking part and two side surfaces of the U-shaped body, and the first lock body is moved to the other end of the slot on the second lock body. As the locking part is partially located in the slot of the second lock body, during the displacement, the slot walls of the second lock body abut against the locking part, so that the locking part is in the unlocked state. In this case, the convex members on the two side surfaces of the U-shaped body are engaged with the convex members on the slot walls of the second lock body. A second locked state is formed now. When the first lock body is moved once again, unlocking can be completed only by pressing the U-shaped body with two fingers.

Definitely, in this example, the movable part can also be in an elastic form. As shown in FIG. 5, it is in the shape of a cylinder, the bottom of one end of the cylinder projects to form a convex member, a spring is mounted between the other end and the fan-shaped body, and the center of the end projects to be engaged with the concave part in the middle of the locking part.

Example 3

Figure 9:
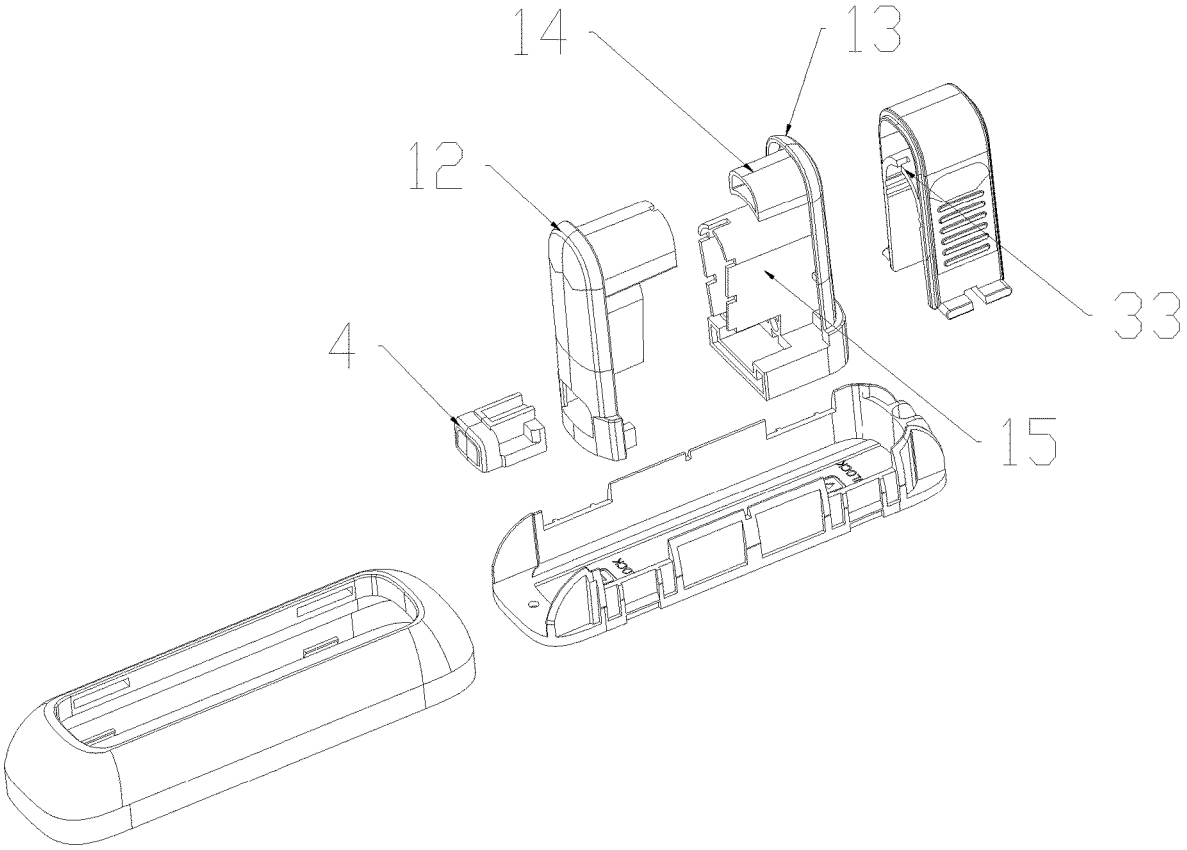
FIG. 9 is an exploded structural diagram of a door handle lock according to Example 3.
Figure 10:
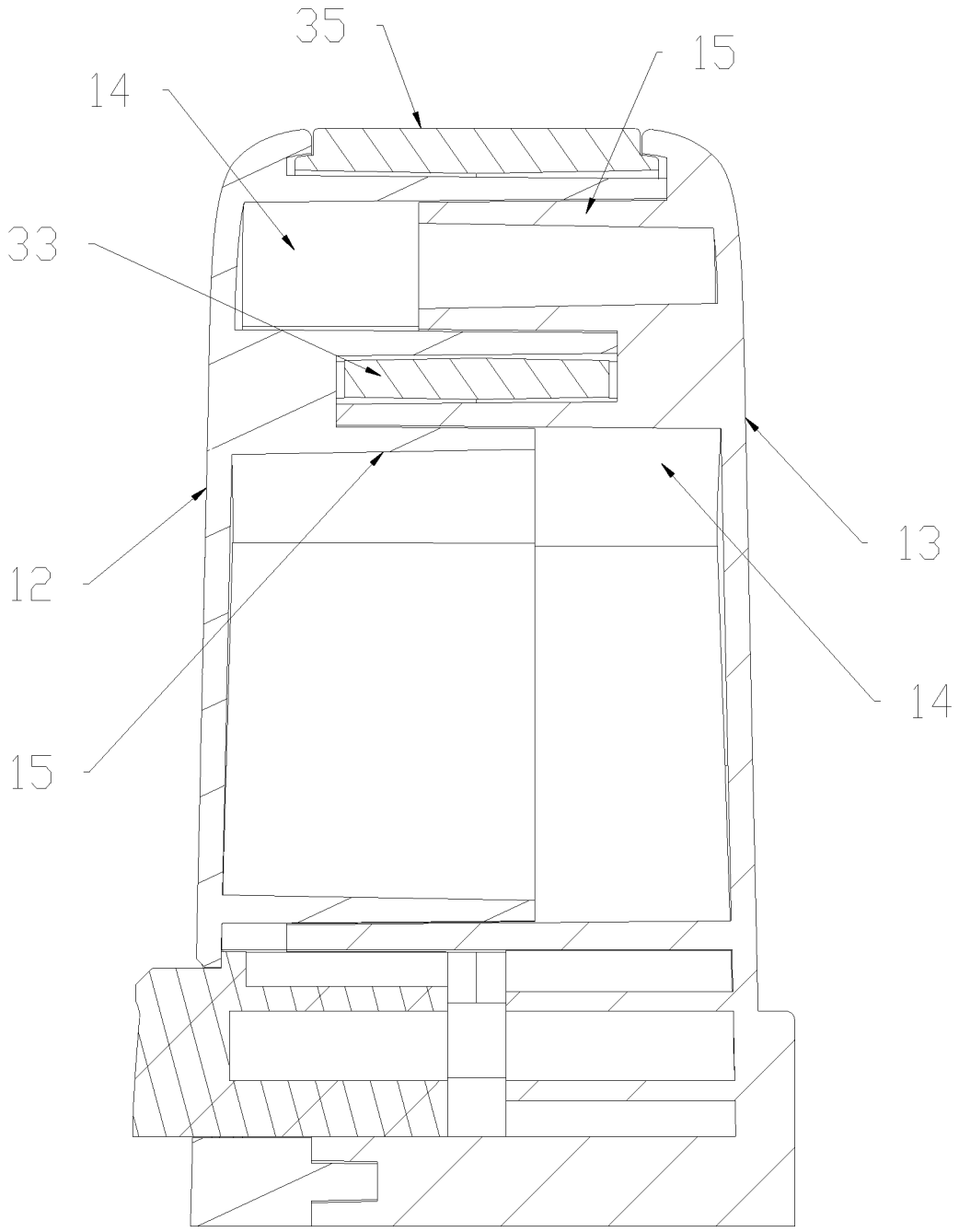
FIG. 10 is a sectional structural diagram of a first lock body according to Example 3.

Referring to FIG. 9 and FIG. 10, compared with Example 2, in this example, a left part 12 and a right part 13 of the first lock body are fixed by embedment. A surface of the left part facing the right part is provided with a convex part and a concave part that are distributed vertically. The corresponding surface of the right part is correspondingly provided with a concave part 15 and a convex part 14, for fixing by embedment. In this example, two movable parts are integrated into a U shape. The slot of the U-shaped body is provided with holes spaced apart by a partition 33. During mounting, the concave part at the upper portion of the left part of the first lock body passes through the hole to be fixed to the convex part of the right part by embedment, and the concave part at the lower portion of the right part of the first lock body passes through the slot of the U-shaped body to form a fan-shaped body with the convex part of the left part by embedment. This structure improves the stability of the movable parts.

Example 4

Figure 11:
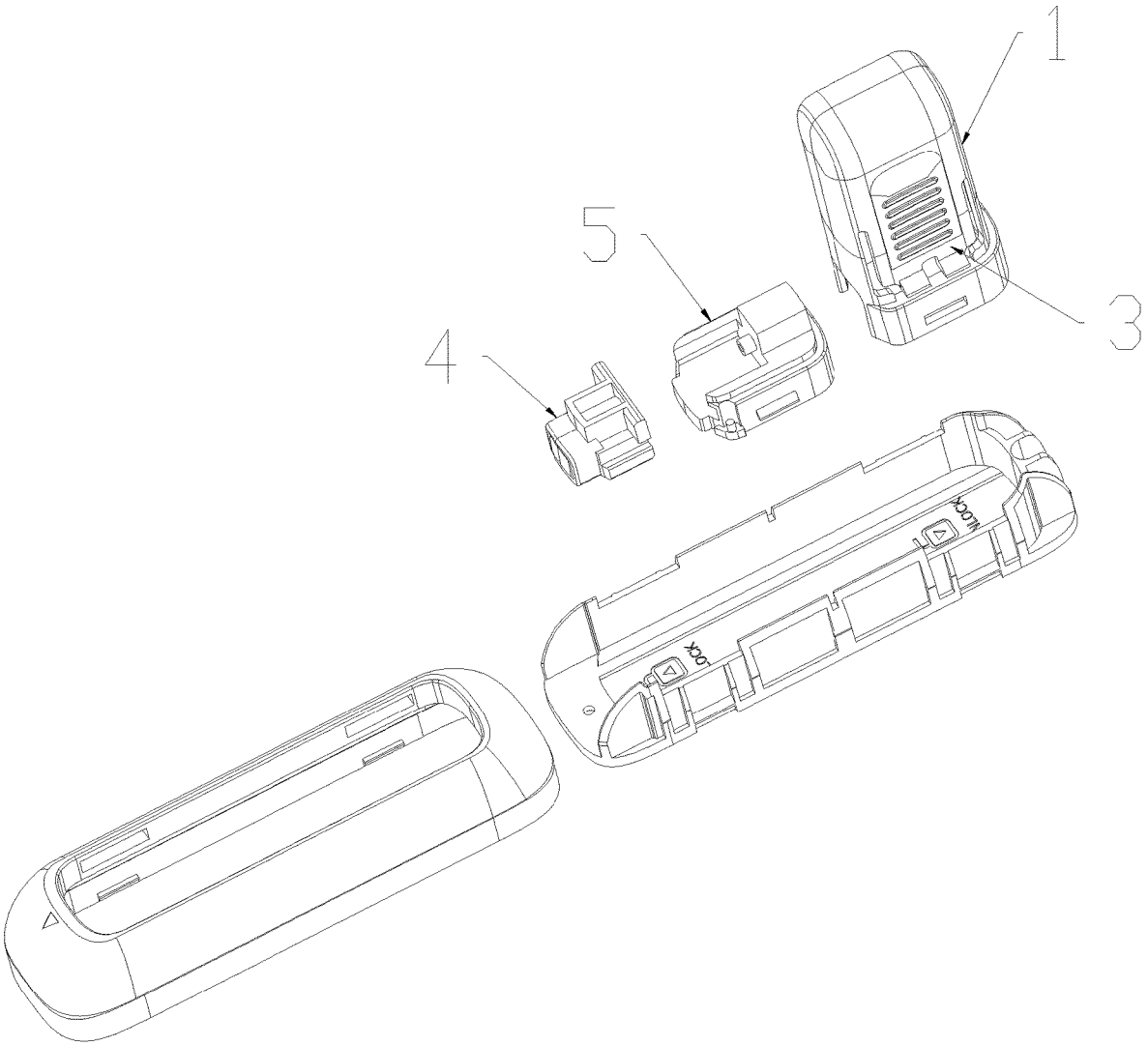
FIG. 11 is an exploded structural diagram of a door handle lock according to Example 4.
Figure 12:
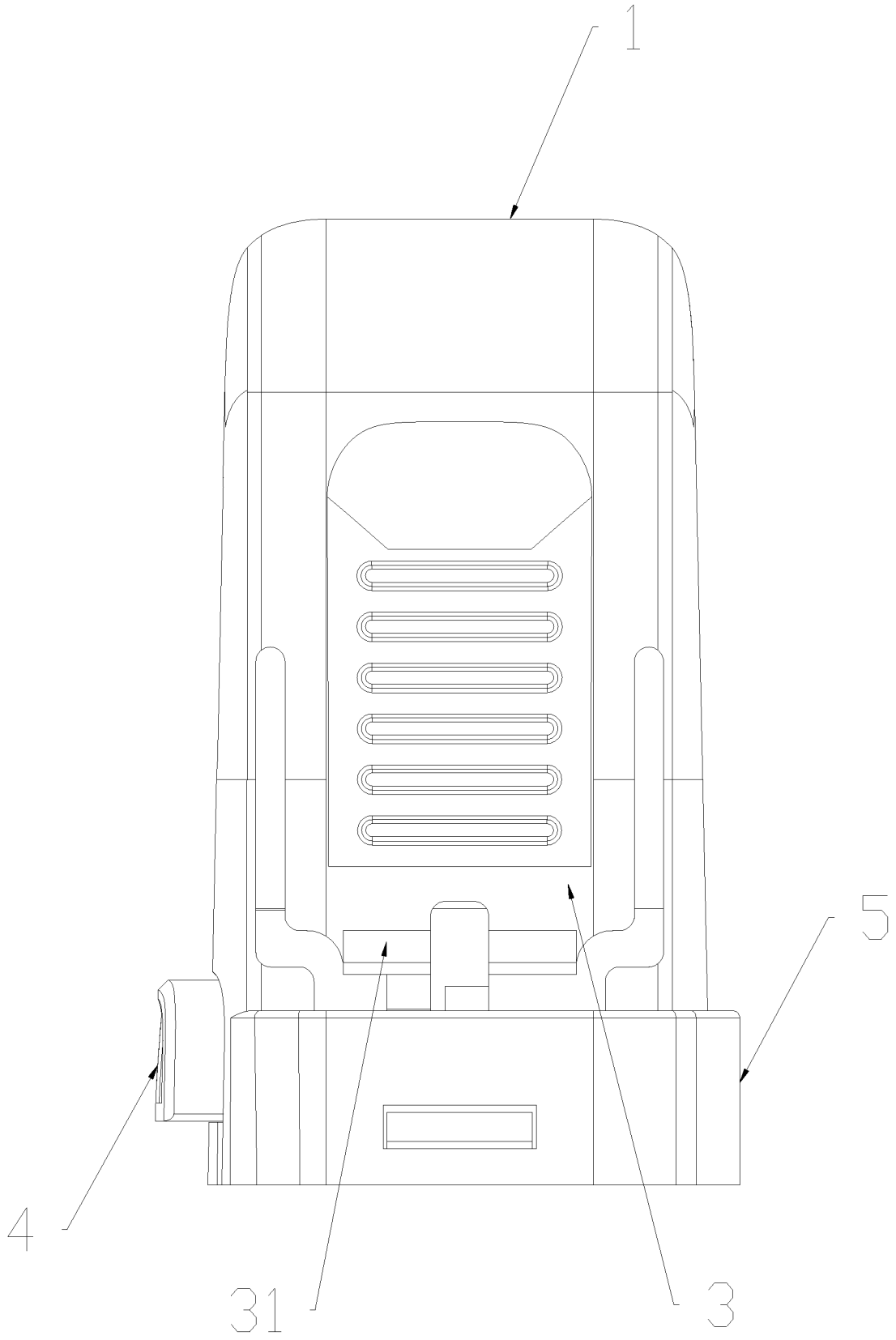
FIG. 12 is a structural diagram of mounting a first lock body and a base according to Example 4.

Referring to FIG. 11 and FIG. 12, compared with Example 3, in this example, the first lock body is in the shape of a barrel. Ends on two opposite side surfaces thereof are separated from each other, that is, adjacent three sides of the ends on the two side surfaces are all slotted and separated from the first lock body. The end on the side surface forms a movable part 3. The bottom of the end on the side surfaces is provided with a convex part to form a convex member 31. In this example, the movable part is integrated with the first lock body, and the second lock body is shaped by fixing upper and lower parts by embedment. Slot walls on two sides of the upper part are directly provided with holes to form a concave member. A base 5 is further included in this example, equivalent to a T-shaped transverse part. The base is placed in the slot of the second lock body, the first lock body is directly fixed onto the base by embedment, the bottom of the first lock body is slotted to form a mounting hole, and the locking part is placed in the mounting hole and moves along the top surface of the base.

Preferably, two sides of the base project, and holes are opened on the corresponding barrel walls of the first lock body, and the projecting parts are placed in the holes to form embedded fixing.

Example 5

Figure 13:
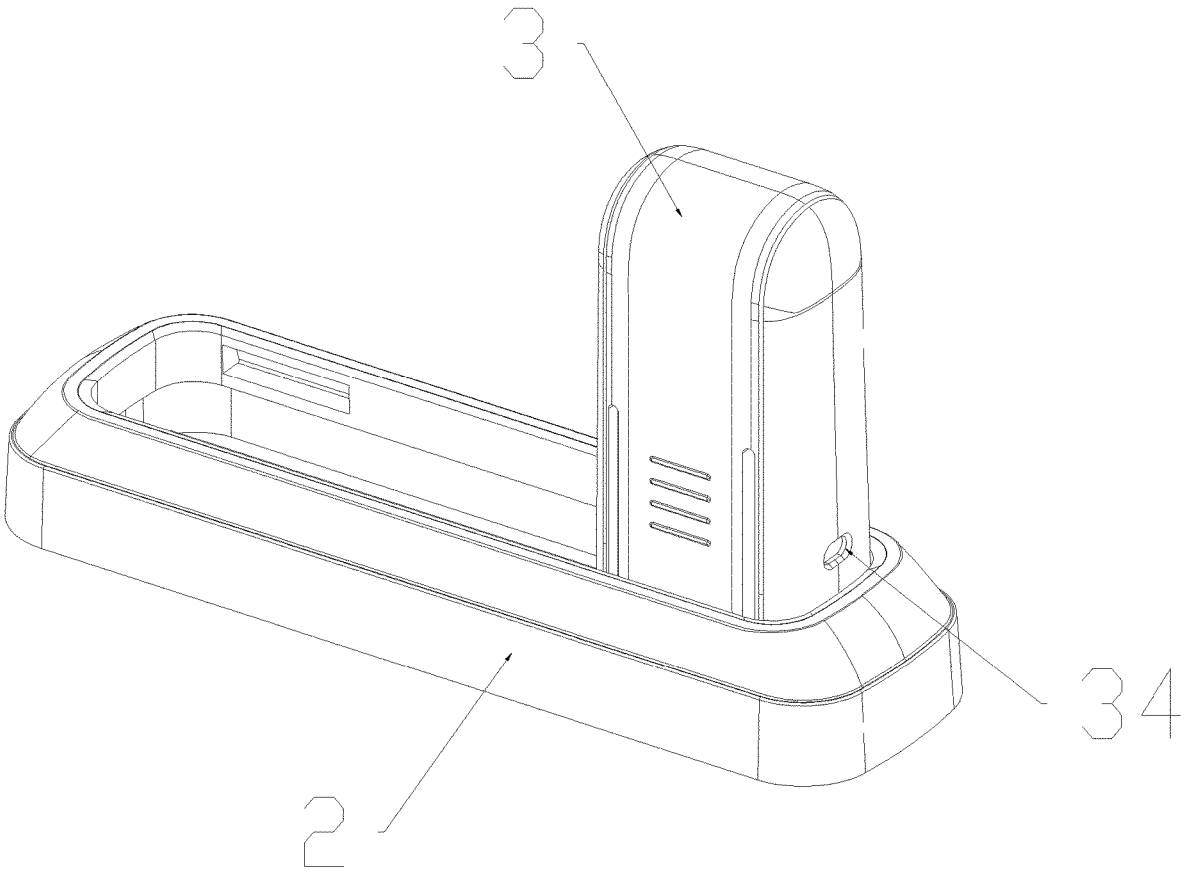
FIG. 13 is a structural diagram of a door handle lock according to Example 5.
Figure 14:
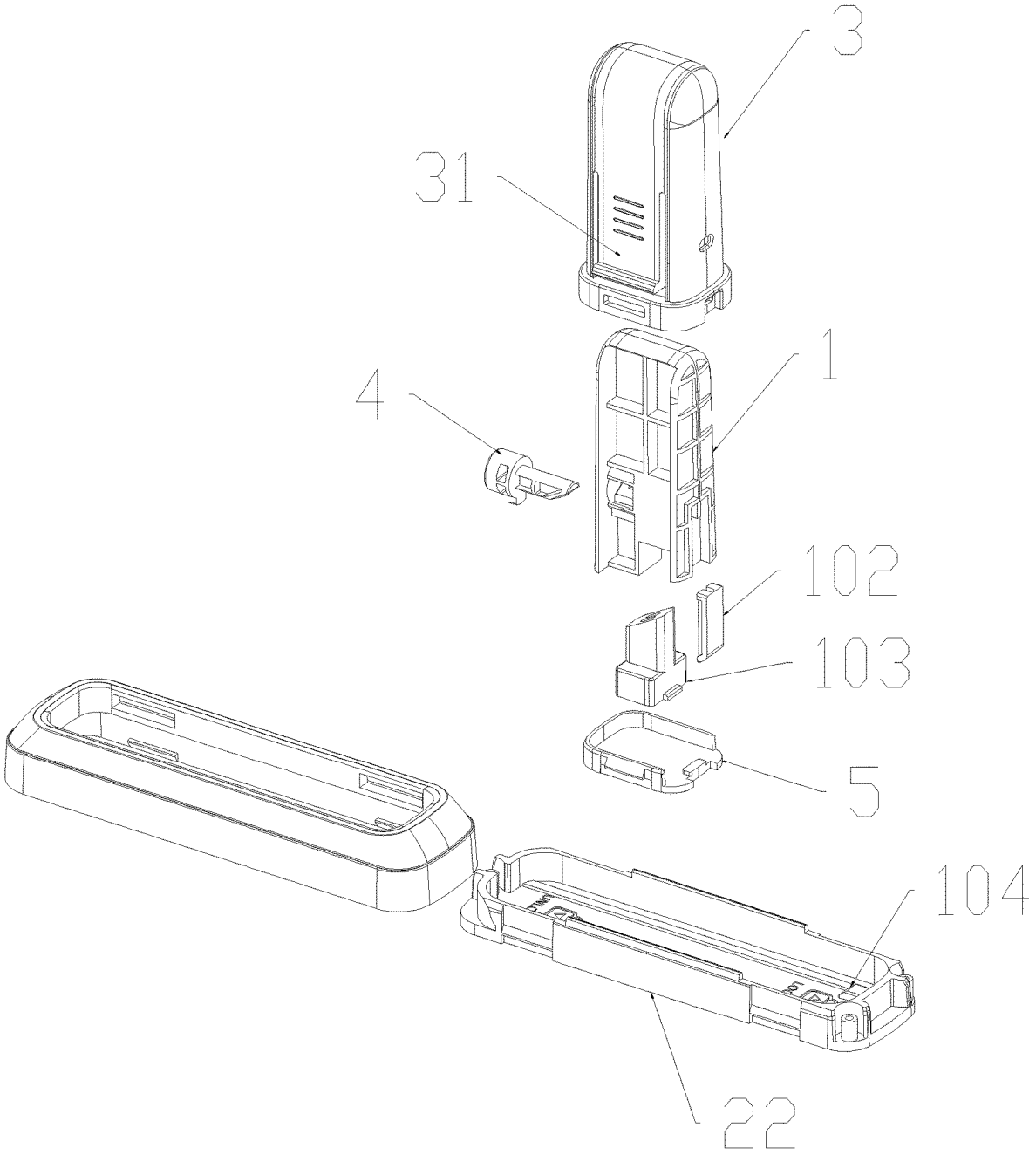
FIG. 14 is a sectional structural diagram of the door handle lock according to Example 5.
Figure 18:
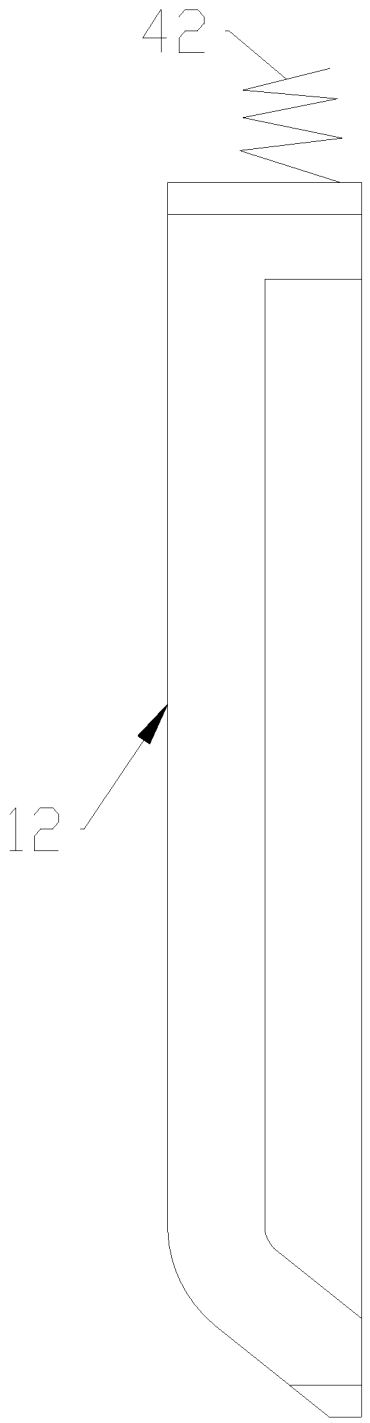
FIG. 18 is a structural diagram of an indicator block.

Referring to FIG. 13, FIG. 14 and FIG. 18, compared with Example 4, referring to FIG. 13 and FIG. 14, in this example, two movable parts are connected into a barrel. Adjacent three sides of ends on two opposite side surfaces of the barrel are all slotted and separated from the first lock body. The ends on the side surfaces form a movable end for pressing and displacement. The bottom of the end on the side surface is provided with a convex part to form a convex member 31. The first lock body is directly fixed onto the base in the slot of the second lock body by embedment. The movable part is directly sheathed on the first lock body and fixed to the base by embedment. Preferably, two sides of the base project, and holes are opened on corresponding barrel walls of the movable parts, and the projecting parts are placed in the holes to form embedded fixing. The locking part 4 is a cylinder with a stepped shape. The step surface is concave and convex. The corresponding inner surface of the lateral end of the barrel is correspondingly concave and convex. The front of the first lock body is provided with a hole for inserting and mounting the cylinder.

Referring to FIG. 14, in this example, a first pushing block, a second pushing block, and a third pushing block 103 are further included. The first pushing block is integrated with the second pushing block, which is placed at one end of the slot of the second lock body. The second lock body is shaped by fixing the upper part 21 and the lower part by embedment, and one end of the lower part 22 thereof fixes the first pushing block 104.

Referring to FIG. 14, the first lock body is provided with an accommodating slot 105 in which the third pushing block 103 is placed. An upper portion of the accommodating slot is provided with a hole for the cylinder to insert. One side of the bottom of the accommodating slot is provided with a hole towards the first pushing block. During the displacement of the first lock body, the first pushing block is inserted into the hole from below the third pushing block to jack up the third pushing block, so that the third pushing block abuts against and fixes the cylinder extending from the top of the accommodating slot.

Referring to FIG. 14, as a more optimized selection, the second pushing block is arc-shaped or its end is a slope, the second pushing block abuts against the bottom of the third pushing block, and with the displacement of the first lock body, the third pushing block moves along the second pushing block and rises to abut against and fix the cylinder in the hole.

Referring to FIG. 14 and FIG. 18, as a more optimized selection, an indicator block 102 is further included. The back of the first lock body is provided with a slot for mounting the indicator block, which is adjacent to the accommodating slot. Color bars are painted on the indicator block. The corresponding position on the barrel of the movable part is provided with an observation hole 34. During the displacement of the first lock body, the first pushing block 104 drives the indicator block 102 to displace so that the color bar part corresponds to the observation hole, for marking the state of the first lock body. Preferably, a spring is mounted between the top of the indicator block and the first lock body.

In this example, a stop block 41 is disposed at the bottom of the cylinder, and a spring is mounted between the stop block and the corresponding slot wall.

In use, the second lock body is fixed onto the door with bolts or by glue. In this example, the first lock body is far away from the rotation range of the door handle when in the first locked state. In this case, the first pushing block is mounted on the other end of the slot of the second lock body opposite the end of the first lock body. When the locking of the first lock body is released by three fingers and the first lock body moves to the other end of the slot along the second lock body, the first pushing block passes below the slot where the indicator block is located and the accommodating slot. With the displacement, the first pushing block gradually jacks up the indicator block and the third pushing block in the accommodating slot. The color on the indicator block can be observed from the observation hole, and the third pushing block abuts against and fixes the cylinder that is pressed to be released from limiting to the movable part. In this case, when the first lock body is in the second locked state, the first lock body blocks the door handle from rotating, and unlocking can be completed now only by pressing the movable part with two fingers. Such a structure setting has the following advantages. In the second locked state, the first lock body blocks the door handle from rotating, thus preventing a child from opening the door without permission. In the first locked state, the first lock body removes the limit to the rotation of the door handle, but it effectively prevents a child from mistakenly moving the first lock body to the second locked state so that the door cannot be opened from the outside.

In addition, the first lock body is in the locked state with the second lock body in either the first locked state or the second locked state. Therefore, in another implementation manner, when the first lock body in the first locked state blocks the door handle from rotating, the unlocking requires the cooperation of three fingers, it is difficult to unlock, and cannot easily unlocked by a child. When the first lock body is moved to the other end of the slot of the second lock body, it is in the second locked state, and in this case, the first lock body can be reset to the first locked state with the cooperation of only two fingers to limit the rotation of the door handle.

Example 6

Figure 15:
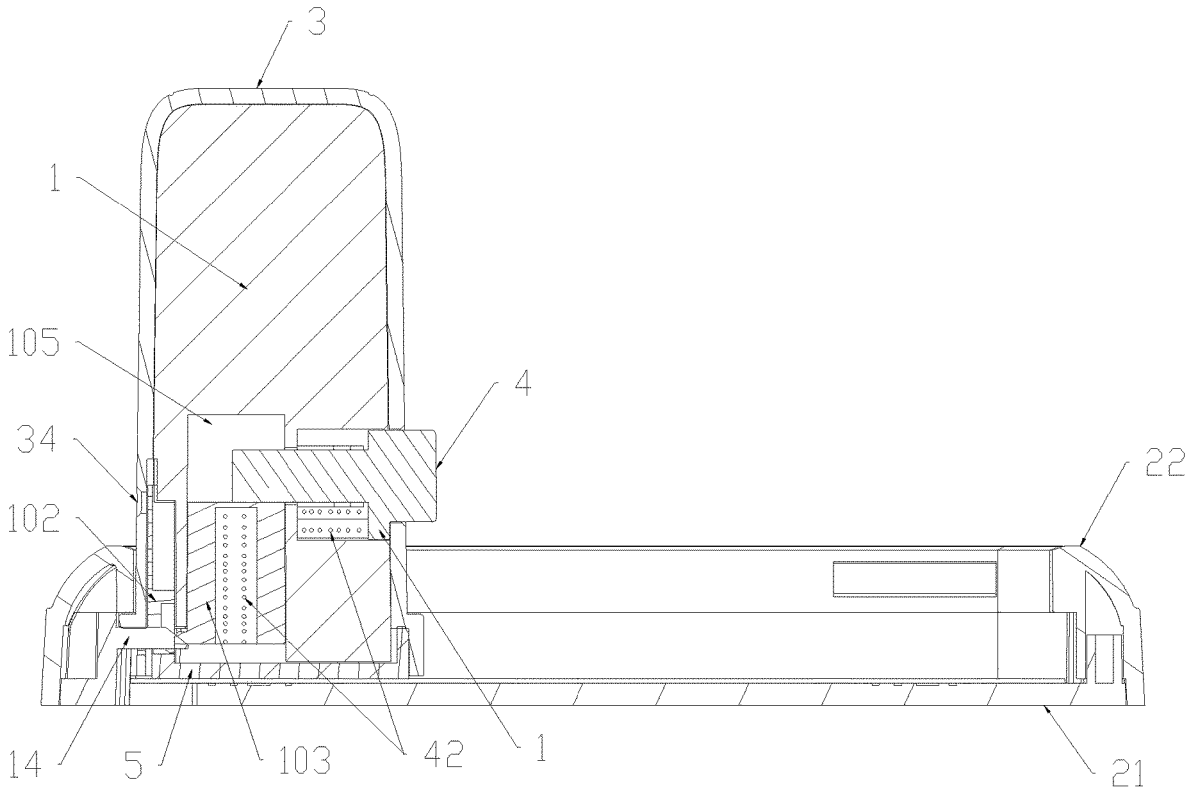
FIG. 15 is an exploded structural diagram of a door handle lock according to Example 6.
Figure 16:
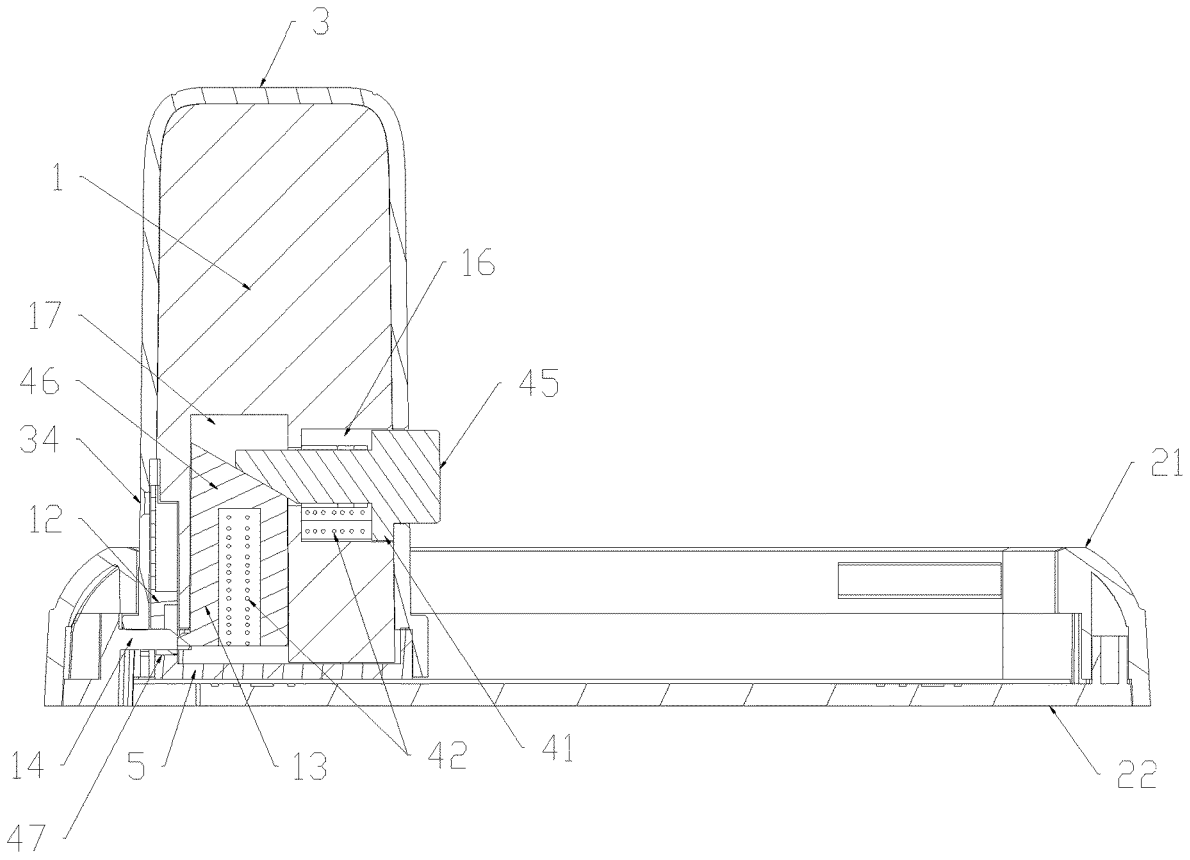
FIG. 16 is a sectional structural diagram of the door handle lock according to Example 6.

Referring to FIG. 13, it is a global view of the door handle lock in this example. Referring to FIG. 15 and FIG. 16, in this example, two movable parts 3 are connected into a barrel. Adjacent three sides of ends on two opposite side surfaces of the barrel are all slotted and separated from the first lock body. The ends on the side surfaces form a movable end 31 for pressing and displacement. The bottom of the end on the side surface is provided with a convex part 311 to form a convex member. A convex part 311 is also disposed on an inner side surface, which corresponds to the locking part. The first lock body is directly fixed onto the base 5 in the slot of the second lock body by embedment. The movable parts are directly sheathed on the first lock body 1 and fixed to the base 5 by embedment. Preferably, two sides of the base project, and holes are opened on the barrel walls of the corresponding movable parts, and the projecting parts are placed in the holes to form embedded fixing.

Figure 19:
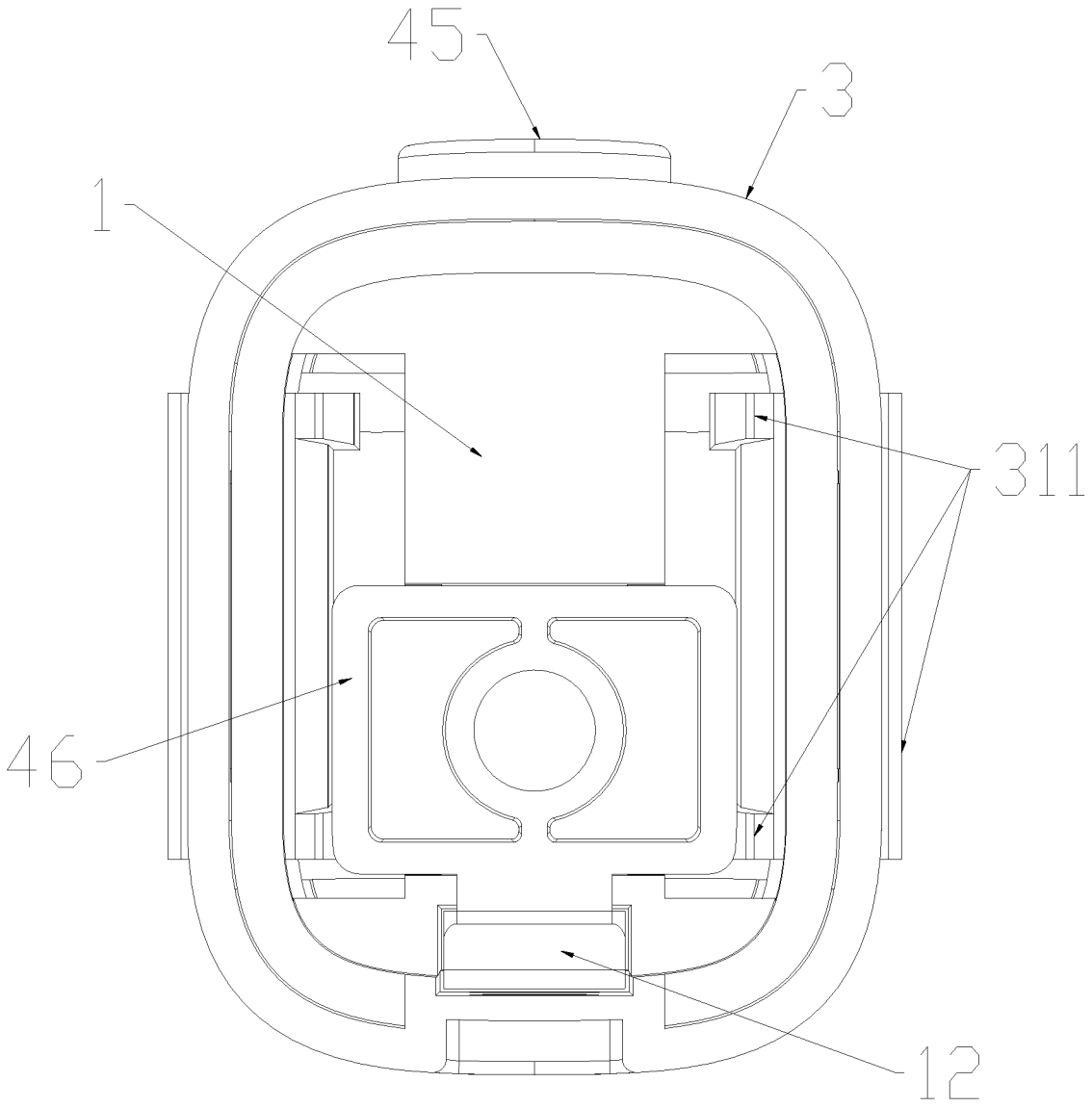
FIG. 19 is a structural bottom diagram of a first lock body according to Example 6.

Referring to FIG. 16 and FIG. 19, the locking part is configured as a cylinder including a first cylinder 45 and a second cylinder 46. The back of the first lock body is provided with a first mounting hole 16 for mounting the first cylinder, the bottom of the first lock body 1 is provided with a second mounting hole 17 for mounting the second cylinder, and movable ends 31 of the movable parts are provided on two sides of the second mounting hole. The first mounting hole is disposed horizontally, the second mounting hole is disposed vertically, the first mounting hole is connected to the second mounting hole, an end of the first cylinder opposite the second cylinder is an inclined surface, the first cylinder retracts inward when pressed by an external force, and the first cylinder abuts against and presses the second cylinder downward so that a projecting part on the surface of the second cylinder is released from limiting the movable part.

Figure 17:
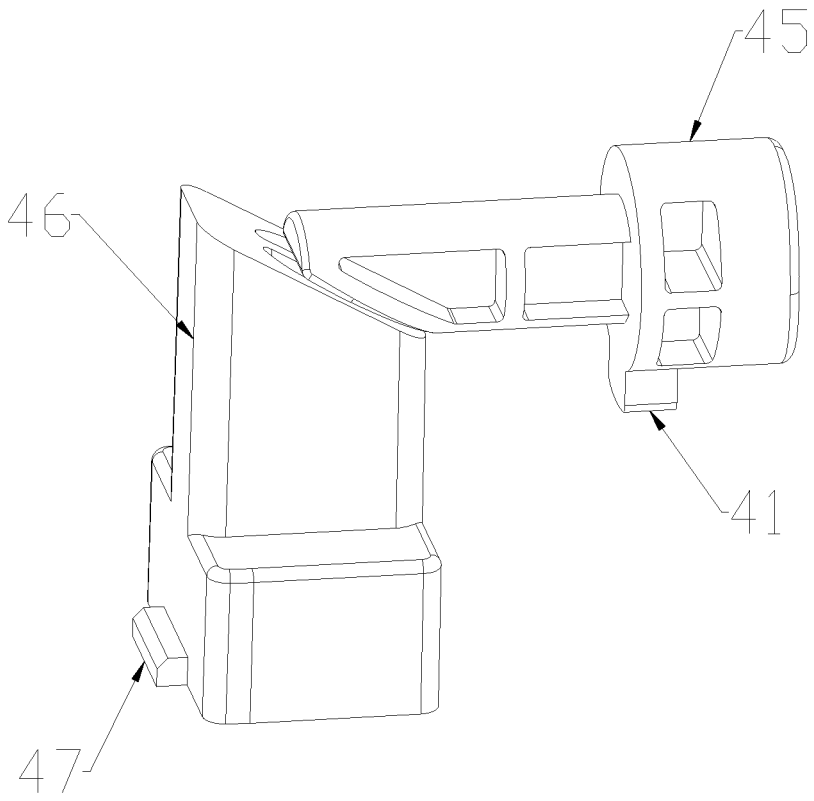
FIG. 17 is a structural diagram of a locking part according to Example 6.

Referring to FIG. 17 and FIG. 19, the second cylinder is in a stepped shape, and the step part at the bottom forms a convex part 311 to limit the movable end of the movable part. The top of the second cylinder is an upper slope, the end of the first cylinder is a lower slope, the upper slope of the first cylinder is attached to the upper slope of the second cylinder by pressing the first cylinder to displace, and as the first cylinder is pressed continuously, the first cylinder presses the second cylinder downward, and the convex part on the second cylinder is displaced to be released from limiting the movable part. In this case, unlocking is completed by pressing the movable part.

Moreover, the middle part of the first cylinder extends downward to form a stop block 41. A spring 42 is mounted between the stop block and the wall of the opposite first mounting hole. The bottom of the second cylinder is provided with a hole in which the spring 42 is mounted. The other end of the spring abuts against and is fixed to an upper surface of the base 5. Referring to FIG. 16, a fourth pushing block is further included, which is mounted to the end of the second lock body. With the movement of the first lock body, the fourth pushing block extends from below the second mounting hole and fixes the second cylinder.

Preferably, a pressing block 47 is disposed on a surface of the second cylinder facing the fourth pushing block. With the movement of the first lock body, the fourth pushing block is pressed over the pressing block to block the second cylinder from moving.

Preferably, referring to FIG. 15, FIG. 16, FIG. 17 and FIG. 18, an indicator block 102 is further included, which is mounted in the slot on the first lock body. The slot is adjacent to the second mounting hole. In this example, the slot is disposed on a side surface of the first lock body, and the indicator block is placed in the slot on the side surface. The barrel of the movable part is sheathed on the first lock body, and an observation hole 34 is provided on the barrel of the movable part corresponding to the position where the color bars are painted on the end of the indicator block. In the process that the first lock body is displaced towards the first pushing block, the arc-shaped end of the fourth pushing block extends from below the indicator block to jack up the indicator block. As the first lock body continuously moves, the end of the fourth pushing block is moved to above the pressing block. In this case, with the removal of the external force, the first cylinder is reset, and the second cylinder is limited by the fourth pushing block to be in a state of not limiting the movable part, i.e., in the second locked state.

Referring to FIG. 18, preferably, a spring 42 is mounted on the indicator block, and two ends of the spring are fixed to the first lock body and the indicator block respectively, thus being conducive to resetting.

In this example, in the first locked state, the first lock body is outside the rotation range of the door handle, and the first lock body at the end of the slot of the second lock body does not block the door handle from rotating. In this case, the fourth pushing block is at the other slot end of the second lock body. As the first cylinder is pressed, the first cylinder abuts against and displaces the second cylinder, and the limit to the movable part is removed. Then the movable part is pressed with two fingers, and the movable part is released from the concave and convex engagement with the second lock body. A force is applied to drive the first lock body to move towards the other end of the slot. During the displacement, the fourth pushing block jacks up the indicator block and fixes the second cylinder. In this case, it is in the second locked state. A user can observe the color of the indicator block from the observation hole to understand the state of the first lock body.

In this example, upper and lower parts of the second lock body are fixed by embedment, and an end of the lower part is integrally formed with the fourth pushing block.

Similarly, in another implementation manner, in the first locked state, the rotation of the door handle is limited by the first lock body. In this case, it is necessary to unlock with three fingers. It is difficult for a child to unlock. After unlocking, the first lock body is moved to the other end of the slot of the second lock body. At this point, it is in the second locked state, in which only two fingers are required to cooperate to release the locking, thus moving the first lock body to the first locked state.

Definitely, the above are merely specific application examples of the present invention, which do not constitute any limitations to the protection scope of the present invention. Any technical solution formed by equivalent transformation or equivalent replacement falls within the protection scope of the claims of the present invention.

The invention claimed is:

1. A door handle lock, comprising:

a first lock body, configured to act on a door handle to lock or remove rotational limit to the door handle;

a second lock body, configured to provide a track for displacement of the first lock body, wherein the second lock body is reciprocally displaced along the first lock body to form a first locked state or a second locked state; and a locking part, configured to limit the first lock body, such that the lock body is maintained in the first locked state, or switched between the first locked state and the second locked state;

wherein the first lock body is provided with a movable part, wherein the movable part and the corresponding second lock body are respectively provided with concave and convex members to form engagement to form a locked or unlocked relationship;

the first lock body comprises a radially curved body, the locking part comprises a convex member, the locking part is cooperated on an outer side of the radially curved body and forms an inward concave part with the radially curved body corresponding to the convex member, and the second lock body comprises a concave member;

wherein the locking part is configured as a cylinder having a concave and convex surface, the cylinder being movably mounted onto the first lock body;

the cylinder comprises a first cylinder and a second cylinder, the front or back of the first lock body is provided with a first mounting hole for mounting the first cylinder, the bottom of the first lock body is provided with a second mounting hole for mounting the second cylinder, and the first lock body on two sides of the second mounting hole is provided with a movable part, wherein the first mounting hole is disposed horizontally, the second mounting hole is disposed vertically, the first mounting hole is connected to the second mounting hole, an end of the first cylinder opposite the second cylinder is an inclined surface, the first cylinder retracts inward when pressed by an external force, and the first cylinder abuts against and presses the second cylinder downward so that a projecting part on the surface of the second cylinder is released from limiting the movable part; and under the action of an external force, the locking part removes the limit, the movable part is released from the concave and convex engagement, and the first lock body moves under the drive of the external force to go distally from a rotation range of the door handle.

2. The door handle lock according to claim 1, wherein an end of the second lock body is further provided with a first pushing block, an indicator block is movably mounted on the corresponding first lock body, and during displacement of the first lock body, the first pushing block drives the indicator block to displace.

3. The door handle lock according to claim 1, wherein the movable part is rotatably connected to the first lock body.

4. The door handle lock according to claim 1, wherein the movable part is elastically retractable, one end thereof is connected to the first lock body, the other opposite end is provided with concave and convex members to be engaged with the concave and convex members on the second lock body, and when the other end is pressed, the movable part contracts to be released from the concave and convex engagement with the second lock body.

5. The door handle lock according to claim 1, wherein the locking part is configured to comprise a body having one end fixed to the second lock body and the other end abutting against the first lock body for limiting, and the other end of the body is pressed to be released from the limit.

6. The door handle lock according to claim 1, further comprising a fourth pushing block mounted to an end of the second lock body, wherein as the first lock body moves, the fourth pushing block extends from below the second mounting hole and fixes the second cylinder.

7. The door handle lock according to claim 1, wherein an elastic member is mounted between the cylinder and the first lock body.

* * * * *